United States Patent [19]

Baggio et al.

[11] Patent Number: 5,001,851

[45] Date of Patent: Mar. 26, 1991

[54] FOOT SECURING DEVICE FOR A FOOTWEAR, PARTICULARLY FOR SKI BOOTS

[75] Inventors: Giorgio Baggio, San Martino Di Lupari; Giuseppe De Bortoli, Montebelluna; Alessandro Bambace, Castelfranco Veneto, all of Italy

[73] Assignee: Nordica S.p.A., Montebelluna, Italy

[21] Appl. No.: 322,134

[22] Filed: Mar. 13, 1989

[30] Foreign Application Priority Data

Mar. 22, 1988 [IT] Italy ..... 82533 A/88

[51] Int. Cl.[5] ..... A43B 5/04

[52] U.S. Cl. ..... 36/119; 36/117

[58] Field of Search ..... 36/117, 118, 119, 120, 36/121

[56] References Cited

U.S. PATENT DOCUMENTS

| | | | |
|---|---|---|---|
| 3,883,964 | 5/1975 | Check | 36/119 |
| 4,539,763 | 9/1985 | Walkhoff | 36/119 X |
| 4,581,831 | 4/1986 | Kirsch | 36/119 |
| 4,583,306 | 4/1986 | Paris | 36/121 X |
| 4,620,377 | 11/1986 | Pozzebon | 36/119 |
| 4,823,485 | 4/1989 | Kemmer | 36/119 |
| 4,916,836 | 4/1990 | Baggio et al. | 36/119 |
| 4,937,953 | 7/1990 | Walkhoff | 36/119 |

*Primary Examiner*—Paul T. Sewell
*Assistant Examiner*—Beth Anne Cicconi
*Attorney, Agent, or Firm*—Guido Modiano; Albert Josif

[57] ABSTRACT

This foot securing device, particularly for ski boots accommodating at least one presser, comprises a grip element accessible from the outside of the boot. The grip element actuates a plate adapted to adjust the pressure exertable on the presser at the metatarsal region. This plate interacts with the presser upon the actuation of a cable winding element, activatable from the outside of the boot and adapted to tension at least one traction element affecting the presser at the foot instep region. The device thus allows the upper surface of the foot to be secured in two separate points by means of a single actuation, while allowing a separate securing adjustment at the two points.

18 Claims, 6 Drawing Sheets

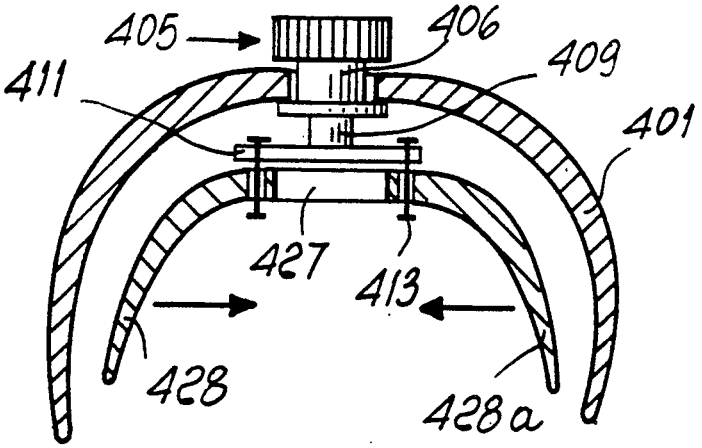
Fig. 13
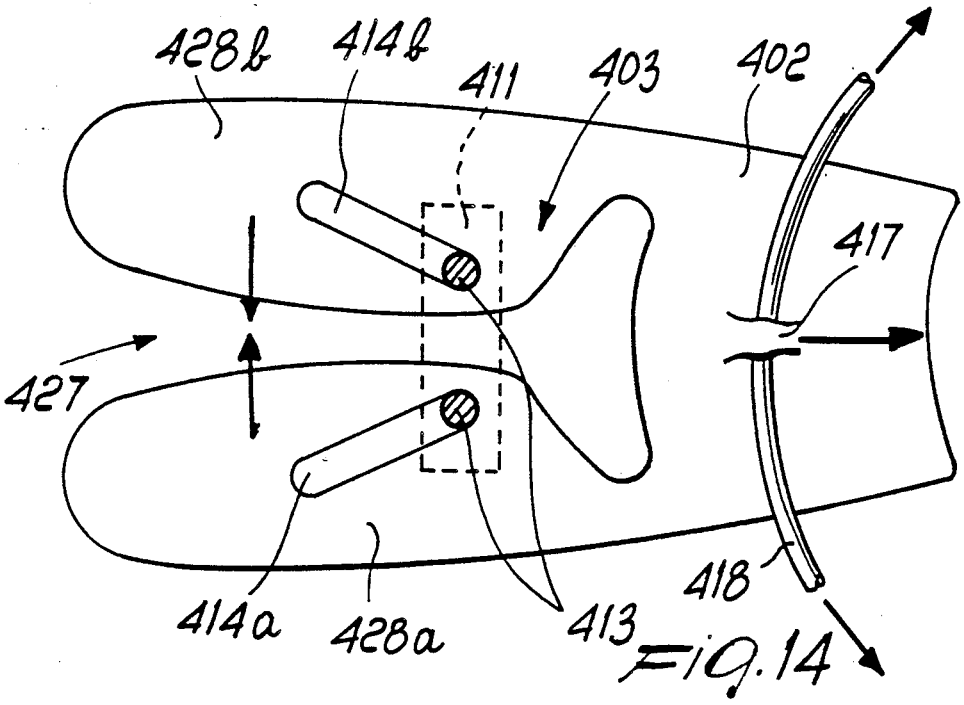
Fig. 14
Fig. 15
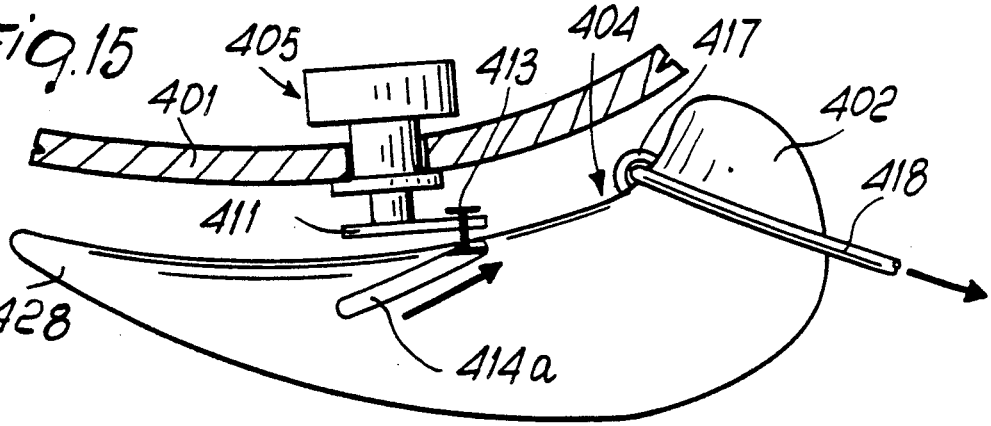

FOOT SECURING DEVICE FOR A FOOTWEAR, PARTICULARLY FOR SKI BOOTS

BACKGROUND OF THE INVENTION

The present invention relates to a foot securing device for a footwear, particularly for ski boots which internally contain at least one presser.

Various devices which allow the foot to be secured inside a ski boot are currently known.

Some, for example, allow only the metatarsal region to be secured by means of a lever associated with a stem having opposite threads and arranged transversely to the shell; said stem interacts with two half-pressers which are specular with respect to the longitudinal middle plane of the boot and can be moved towards or away from each other.

Devices are also known which act by compression on a pawl which interacts with a presser inside the shell.

However, even in this case the securing action is only exerted at a single point, and the structure is considerably complicated, leading to hardly negligible bulks.

A ski boot of the type described for example in DE-U-8408172.4 is also known which comprises a shell having a longitudinal slot in which a wedge-like element is slidably arranged and interacts with an also wedge-like surface provided on the upper part of the inner shoe.

However, even this known type of device has disadvantages: the pressure is difficult to adjust, as it is not easy to position the wedge-like element inside the slot.

The position it assumes is furthermore deemed unstable in view of the considerable stresses imparted while skiing U.S. Pat. No. 4620377 in the name of the same assignee (corresponding to EP-A-85106274.5, filed on 5.22.1985) assumed included herein as reference, discloses a device comprising a kinematism which interacts in two separate points spaced along the longitudinal extension of a presser arranged inside the shell, in order to at least partially solve the above problems.

Though, undoubtedly valid, said device provides, however, a common adjustment for the two points, so that their adjustment cannot be selected independently and it is furthermore impossible to maintain the presetting of the adjustment on the metatarsal region.

The device is furthermore constructively complicated.

SUMMARY OF THE INVENTION

The aim of the present invention is therefore to eliminate the disadvantages described above in known types by providing a device in which the degree of foot securing can be independently adjusted in at least two separate regions of said foot.

Within the scope of the above described aim, an important object is to provide a device which allows the user to rapidly, easily and simultaneously secure at least two separate foot regions.

A further object is to provide a device which associates the preceding characteristics with the possibility of maintaining the preselection of the degree of adjustment imparted at both foot regions and in particular at the metatarsal region.

Not least object is to provide a device which is reliable and safe in operation and is at the same time also structurally simple.

The above described aim and objects, as well as others which will become apparent hereinafter, are achieved by a foot securing device particularly for ski boots, as defined in the appended claims.

BRIEF DESCRIPTION OF THE DRAWINGS

The characteristics and advantages of the invention will become apparent from the detailed description of some particular but not exclusive embodiments, illustrated by way of non-limitative example in the accompanying drawings, wherein:

FIG. 13 is a sectional view of a fifth embodiment of the device, taken along a transverse middle plane of the boot;

FIG. 14 is a top plan view of the presser of the device of the preceding figure;

FIG. 15 is a view, similar to that of FIG. 2 of the device according to its fifth embodiment;

DESCRIPTION OF THE PREFERRED EMBODIMENT

Figure 10:
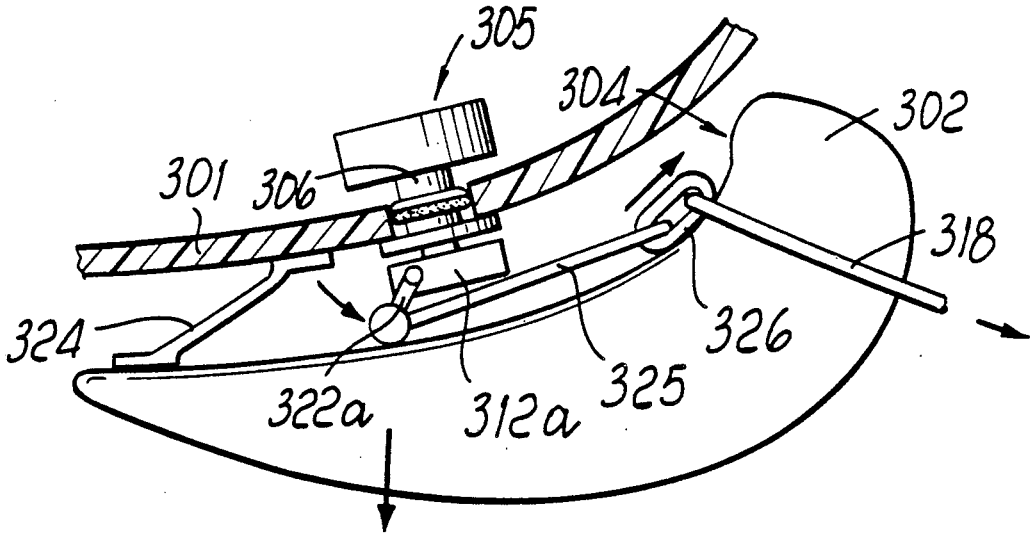
FIGS. 9 and 10 are views, similar to those of FIGS. 1 and 2, of a fourth embodiment.

With reference to the above described figures, the reference numeral 1 indicates the shell or quarter of a ski boot, and 2 indicates a presser arranged inside it.

The presser 2 is arranged at the skier's foot upper surface and comprises a first metatarsal region 3 and a second foot-instep region 4.

The presser 2 is furthermore freely longitudinally movable inside the boot.

First means for adjusting the degree of pressure exertable on the presser 2 are associated with said shell or quarter 1 at the first metatarsal region 3; said first means advantageously comprise a grip element, such as a knob 5, rigid with a bush 6 rotatably associated with said shell or quarter 1.

Said bush 6 is internally hollow and has a thread 7 for a complementarily threaded head 8 of a pawl 9 which, because of the engagement between its head 8 and the thread 7, is axially slidable with respect to said bush and has an end 10 rigidly associated with a small base plate 11.

Towards the second foot-instep region 4, said plate has a pair of wings 12 slidably associated with the presser 2 by means of rivets 13 slidably extending through adapted longitudinal slots 14 of the presser.

On the opposite side with respect to said wings 12, said plate has an arc-like configuration which selectively interacts with a raised portion 15 having a triangular shape in a longitudinal cross section with the inclined surface 16 directed towards the curved end of the plate 11.

One or more small bridges 17 protrude at the second foot-instep region 4 of the presser 2 and slidably accommodate a traction element for example constituted by a cable 18 which can be tensioned by means of adapted second means which can be activated from the outside of the boot and are constituted for example by adapted circular and/or vertical levers and/or manual and/or electric winding assemblies, as schematically shown at 20.

The operation of the device is as follows: if the skier acts at said second means 20 and therefore tensions the cable 18, the foot is secured at the second foot-instep region 4 and the presser 2 is also moved backwards.

This backward motion moves the inclined surface 16 of the raised portion 15 to interact with the curved end of the plate 11, lowering the presser 2 at the first metatarsal region 3.

The first time the skier performs this operation, he may adjust the degree of pressure exertable at the first metatarsal region 3 by acting at the knob 5.

When the second means 20 are deactivated and the cable 18 is therefore slackened, the foot is immediately released, since the presser 2 can move towards the tip of the boot under the action of the pressure of the foot itself, though the adjustment of the degree of pressure which can be imparted at the first metatarsal region 3 remains preset.

It has thus been observed that the invention achieves the intended aim and objects, a device having been provided which allows, the user to independently adjust the foot securing degree at the foot instep and metatarsal regions.

Said device furthermore allows to rapidly and easily simultaneously secure and/or release the foot, the securing action occurring at two separate points.

Since the adjustment of the pressure at the metatarsal region can remain preselected, the subsequent operations for securing the foot merely require the skier to actuate said second means 20 to tension the cable 18.

The invention is naturally susceptible to numerous modifications and variations, all of which are within the scope of the same inventive concept.

Figure 5:
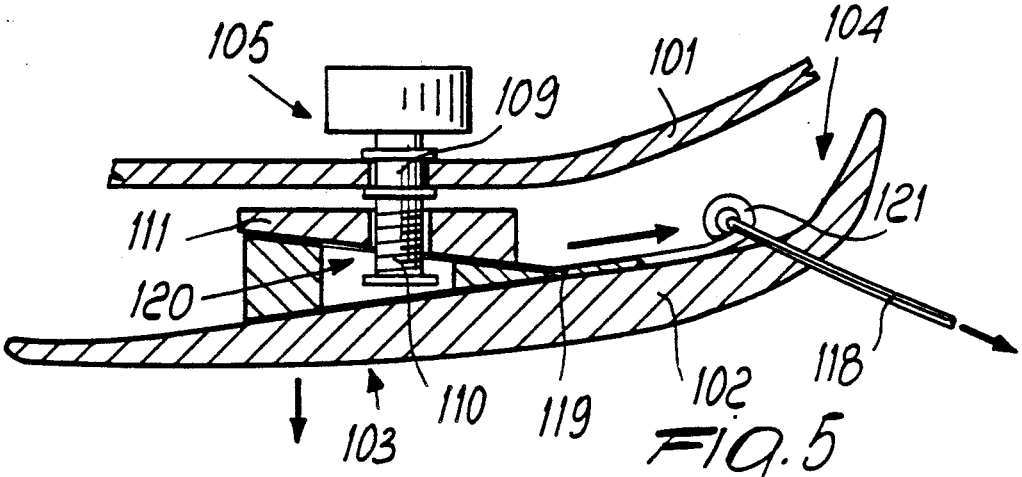
FIG. 5 is a view, similar to the previous one, of a second embodiment.

Thus, for example, FIG. 5 illustrates a second embodiment in which a tab element 119 is slidably associated above and longitudinally to the presser 102 and is interposed between said presser and the shell or quarter 101.

At the end affecting the first metatarsal region 103 said tab has a wedge-like shape with a decreasing thickness towards the second foot-instep region 104.

At the first region 103 said tab has a longitudinal seat 120 for the threaded end portion 110 of a pawl 109 rotatably associated with the shell or quarter 101 and rigid with the knob 105.

A small plate 111 has a threaded hole 125 engaging the end portion 110 of the pawl 109 and is interposed between the tab element 119 and the knob 105 which protrudes from the shell or quarter 101; said plate has a wedge-like configuration with a decreasing thickness in the opposite direction with respect to the tab element 119, that is away from the second foot-instep region 104.

The plate 111 can move along a plane which is perpendicular to the axis of the pawl 109 by virtue of the thread engagement between the latter and the plate 111.

At the region 104, the tab element 119 has a curled shape 121 in which the cable 118 is slidably passed.

The operation is as follows: tensioning of the cable 118 moves the tab element 119 away from the tip of the boot so as to secure the foot at the second foot-instep region 104.

The other end with the wedge-like configuration simultaneously interacts with the plate 111 and presses at the first metatarsal region 103, said pressure being adjustable by means of the knob 105.

Figure 6:
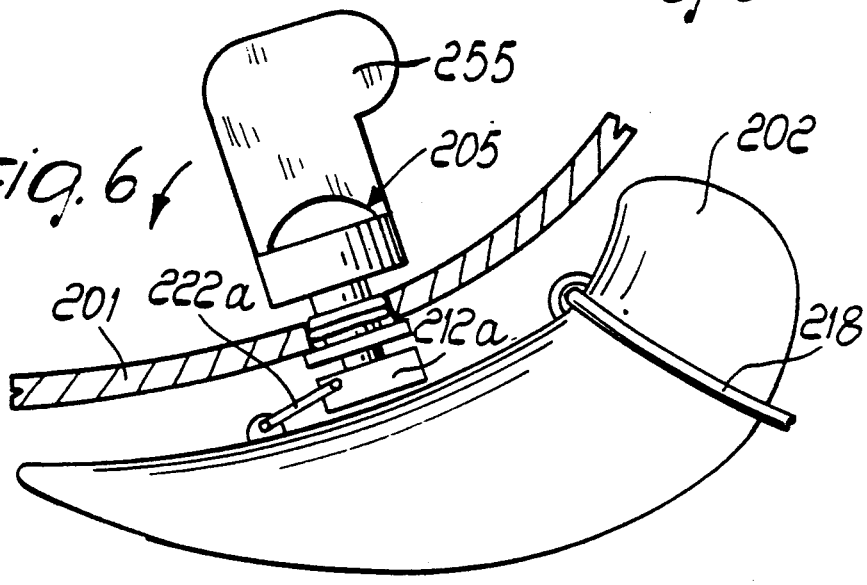
FIGS. 6, 7 and 8 are views, respectively similar to FIGS. 1, 2 and 3, of a third embodiment.
Figure 7:
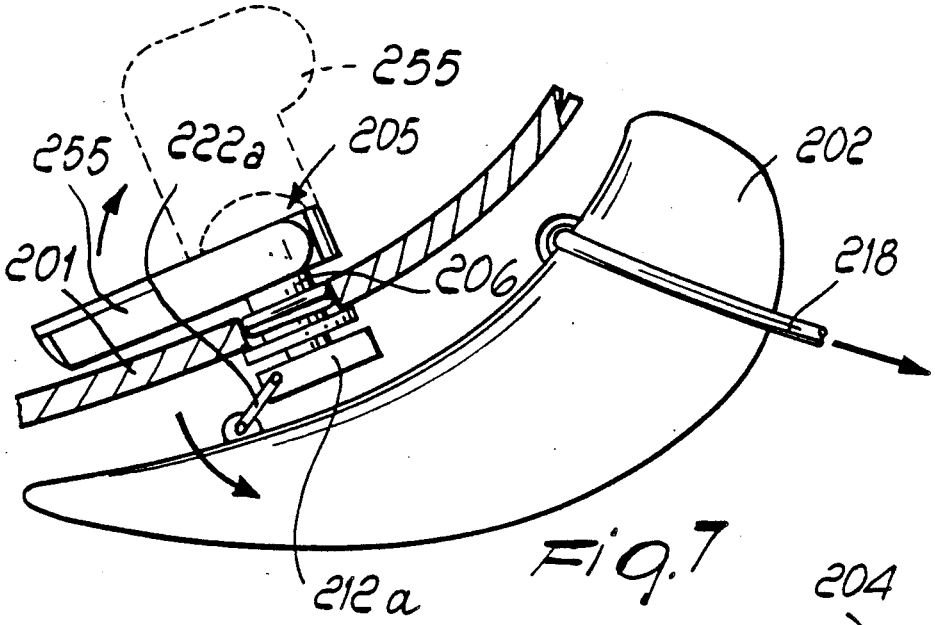
Figure 8:
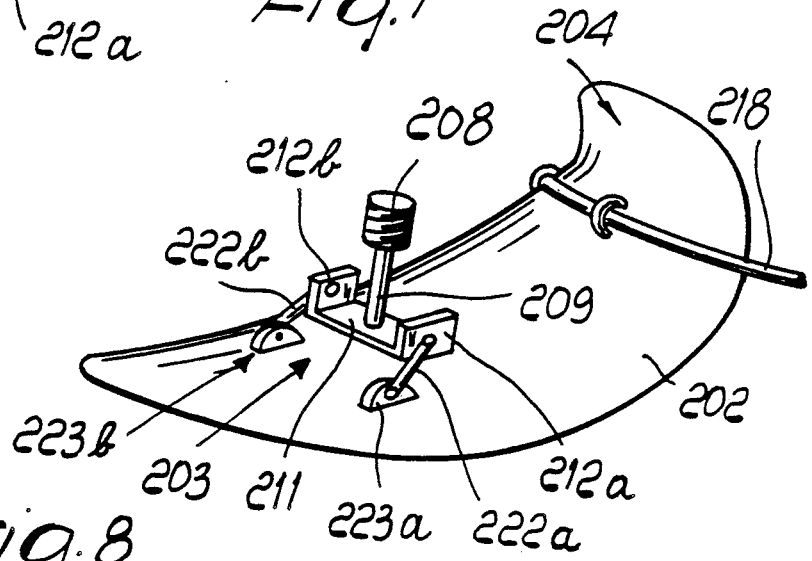
Figure 9:
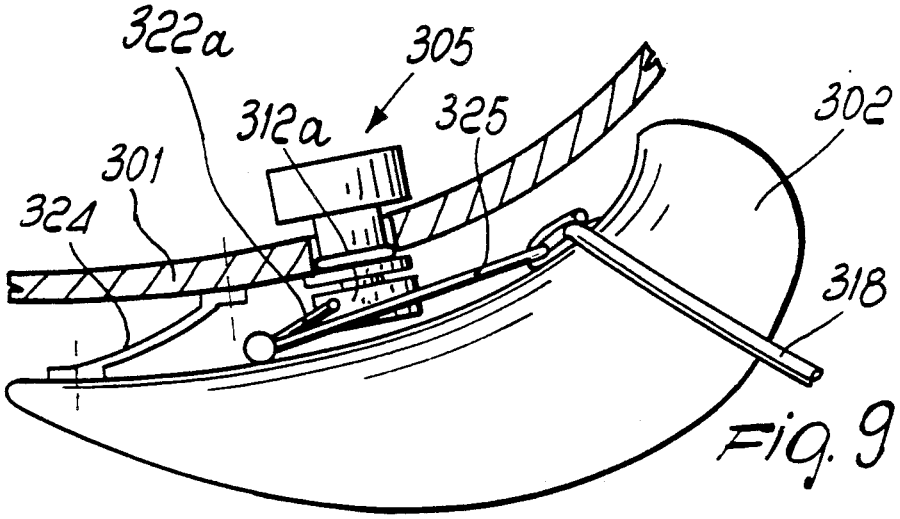
Figure 10:
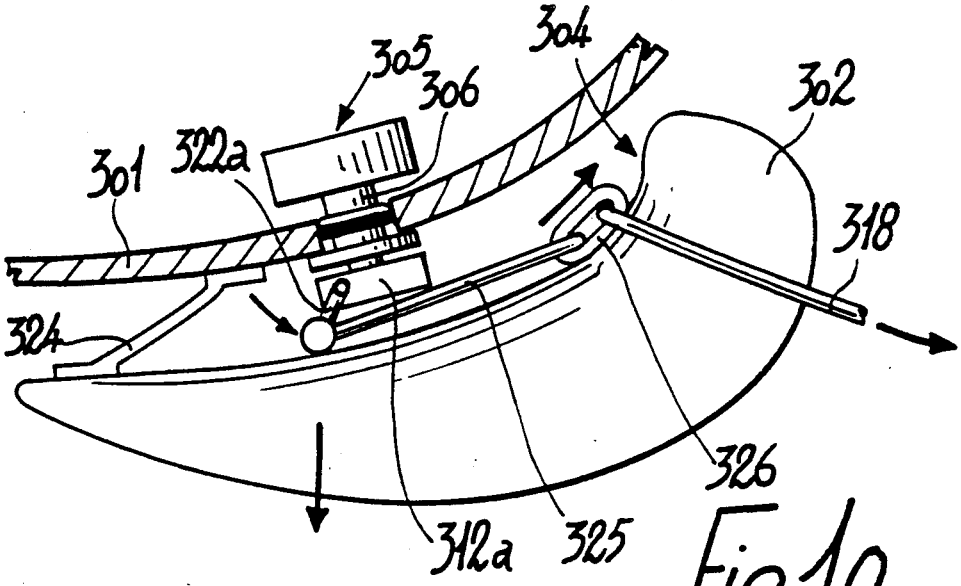
Figure 11:
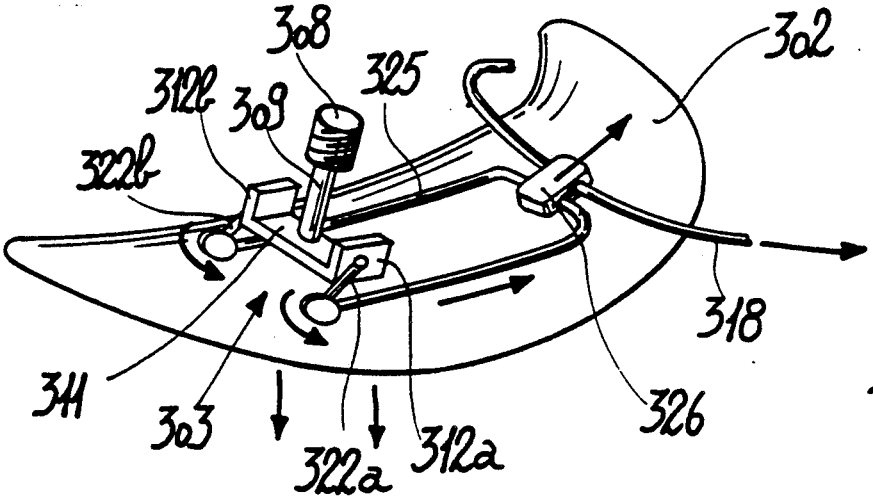
Figure 12:
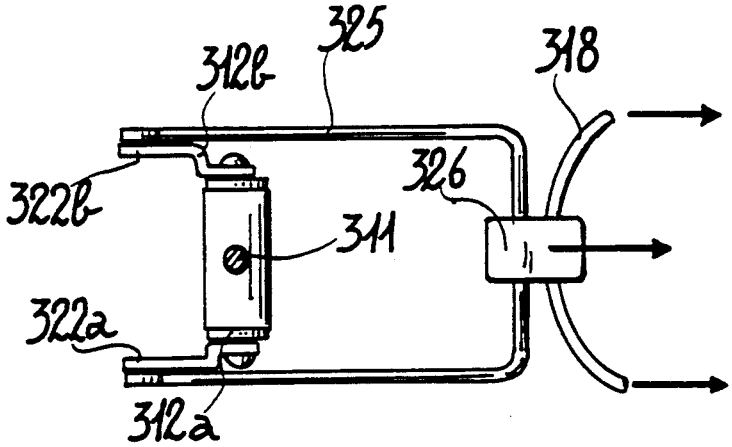

FIGS. 6, 7 and 8 illustrate a third embodiment in which the plate 211 has a pair of lateral wings **212*a* and 212*b* directed towards said quarter or shell 201**.

A pair of connecting rods **222*a* and 222*b* is articulated at one end to said wings and, at their other end, to a pair of raised portions 223*a* and 223*b* protruding from the presser 202** specularly to its longitudinal middle axis.

When the cable 218 is tensioned, the presser 202 moves backwards and consequently increases the pressure exertable at the first metatarsal region 203 by virtue of the rotation of the connecting rods **222*a* and 222*b* with respect to the wings 212*a* and 212*b* and to the raised portions 223*a* and 223*b***.

In this case, too, as in the first embodiment, the plate 211 may be moved in a direction approximately perpendicular to the underlying presser 202.

For this purpose, the plate 211 is advantageously connected to a pawl 209 having a threaded head 208 which can be screwed in a bush 206 similarly to what has been described for the first embodiment.

The bush 206 can be actuated by means of a knob 205 advantageously provided with a pivoted lever 255 which is movable between an actuation position, indicated in solid lines in FIG. 6 and with broken lines in FIG. 7, and a closed position, indicated with solid lines in FIG. 7, for using the boot.

The lever 255 is preferably insertable in a seat of the shell (not illustrated in the figures for the sake of simplicity) when it is in closed position in order to avoid unwanted rotations.

FIGS. 9, 10, 11 and 12 illustrate a fourth embodiment wherein an end of the presser 302, adjacent to the tip of the boot, is associated with the overlying shell or quarter 301 preferably by means of an adapted elastic fork 324.

Connecting rods **322*a* and 322*b* are articulated to the lateral wings 312*a* and 312*b* of the plate 311 and are rotatably associated, at their other end, with the ends of an essentially U-shaped tension element 325**.

The base of said U-shaped tension element 325 is directed towards the second foot-instep region 304, and had a ring 326 connected thereto for slidably accommodating the cable 318.

Figure 11:
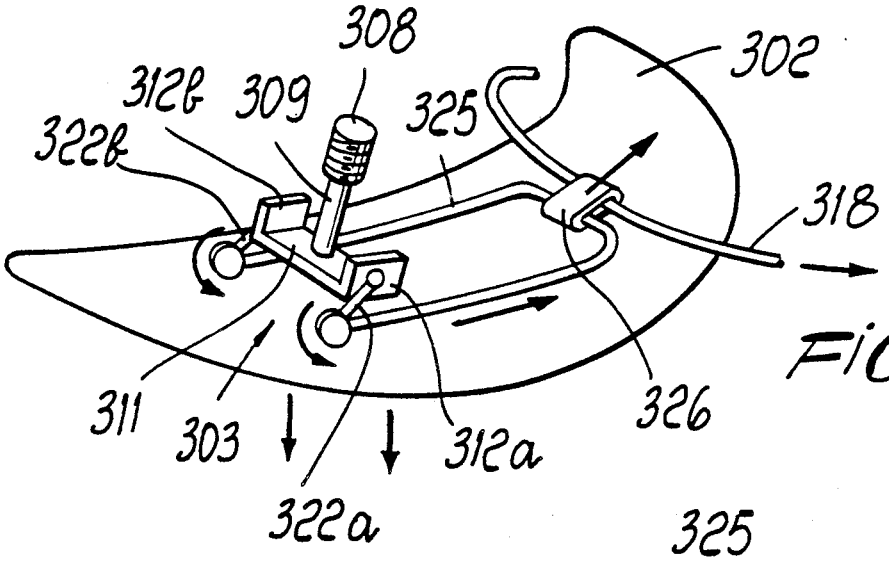
FIG. 11 is a lateral perspective view of the device according to the previous embodiment.
Figure 12:
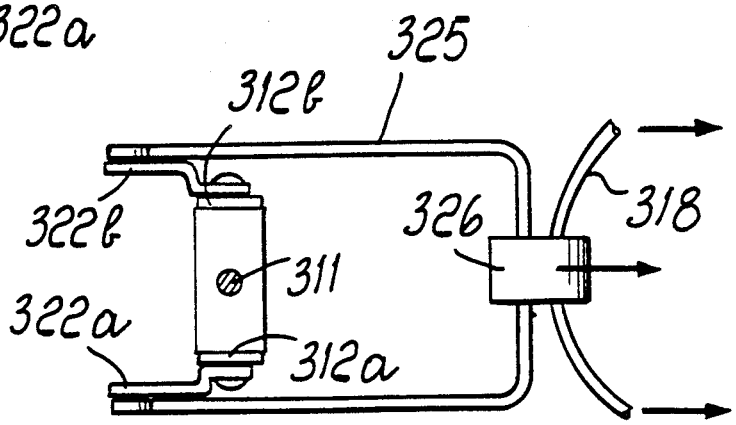
FIG. 12 is a top view of the device of FIG. 11.
Figure 1:
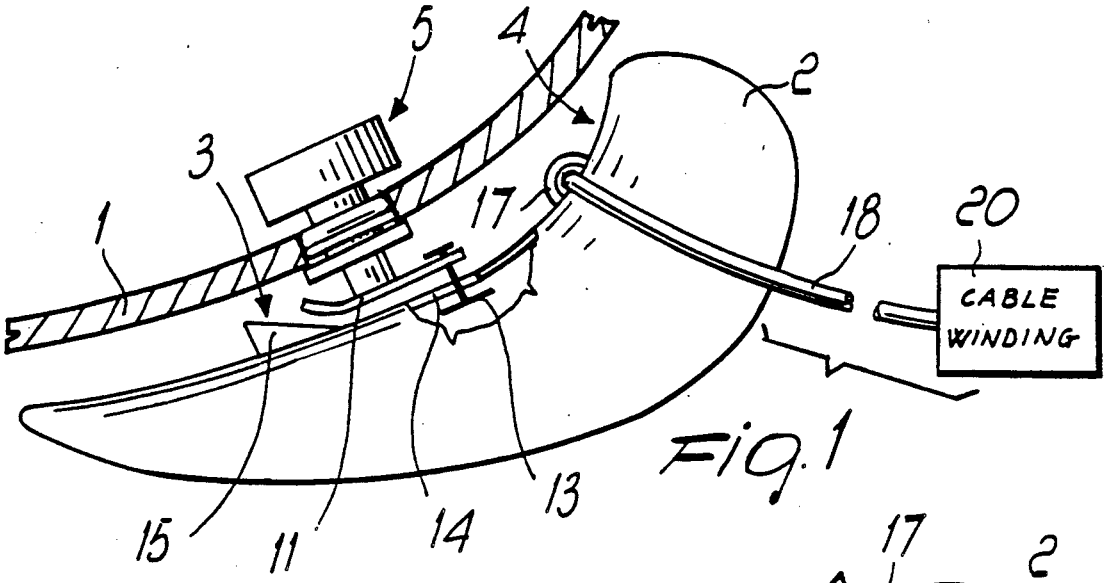
FIG. 1 is a partially sectional side view of the device applied to the shell of a ski boot in the condition in which the means for tensioning a traction element affecting the foot instep region of a presser are not activated.
Figure 2:
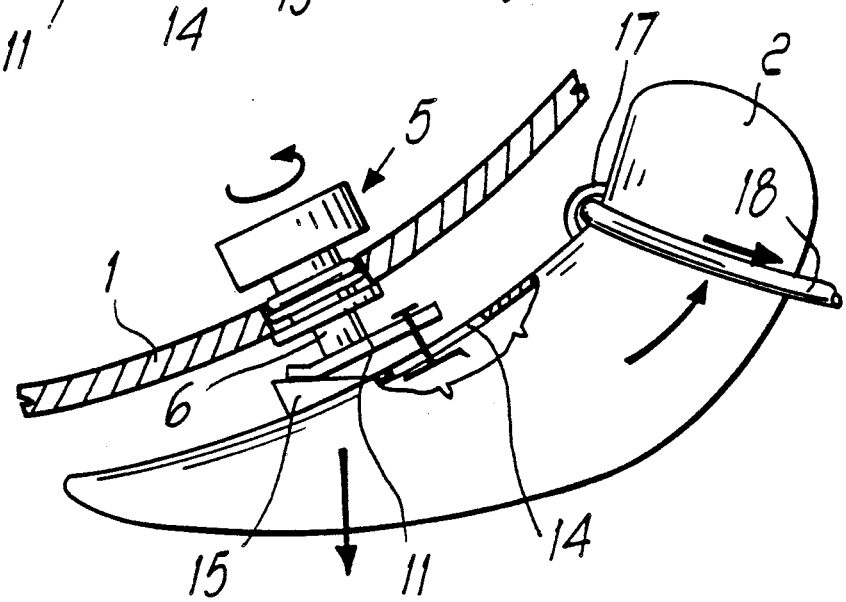
FIG. 2 is a view, similar to the preceding one, of the condition in which said means are activated.
Figure 3:
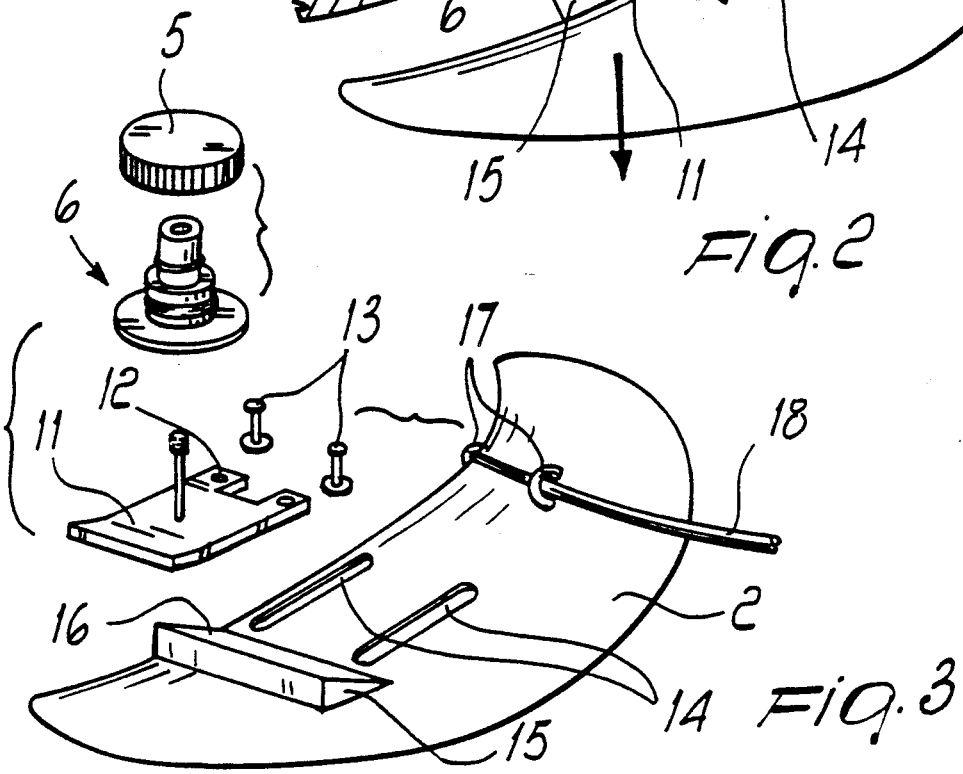
FIG. 3 is an exploded view of some components of the device.
Figure 4:
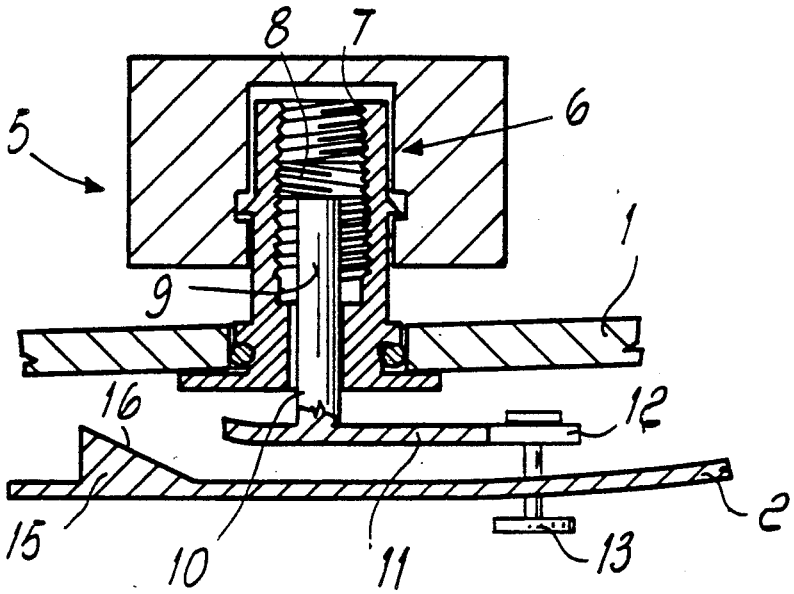
FIG. 4 is a sectional view, taken along a longitudinal middle plane of the boot, of further means which interact with said presser.

Thus, when said cable is tensioned the ring 326 slides with respect to the presser 302 and moves the tension element 325 which rotates the connecting rods **322*a* and 322*b* with respect to the plate 311, pushing the presser 302 at the first metatarsal region 303 against the foot (see the arrows in FIGS. 10, 11**).

In this case, too, the degree of pressure exertable on the presser at said first region 303 can be adjusted with first means constituted by a knob 305 actuating a bush 306 rotatably associated with said shell or quarter 301 and engaging with a threaded head 308 of a pawl 309 rigidly associated with, and protruding from, the plate 311, thereby imparting an axial movement thereto.

FIGS. 13, 14 and 15 illustrate a fifth embodiment, wherein the presser 402 has a longitudinal notch 427 at the first metatarsal region 403; said notch defines a pair of elastically deformable and mutually approachable flaps 428*a* and 428*b*.

A pair of slots 414*a* and 414*b* is provided on said flaps 428*a* and 428*b* again at the first metatarsal region 403; said slots are inclined with respect to the longitudinal axis of the presser and converge with respect thereto at the end directed towards the second foot-instep region 404.

The first means for adjusting the degree of pressure exertable at the first metatarsal region 403 again comprise a knob 405 which actuates a bush 406 rotatably associated with the shell or quarter 401 and engages, by means of a thread, with a pawl 409 which is thus axially movable with respect to said bush and is rigidly associated with a plate 411.

Said plate is slidably associated with the underlying slots 414*a* and 414*b*, provided on the flaps 428*a* and 428*b*, by means of adapted rivets 413 passed through suitable holes in said plate and slidable in said slots.

A tension imparted to the cable 418, which passes under a bridge 417 formed on the presser 402, again moves the presser 402 away from the tip of the boot, causing the flaps 428*a* and 428*b* to approach one another by elastic deformation by virtue of the presence of the rivets 413.

The presser is thus laterally compressed on the foot, and the vertical action to be obtained on said foot is achieved by actuating the knob 405.

Figure 16:
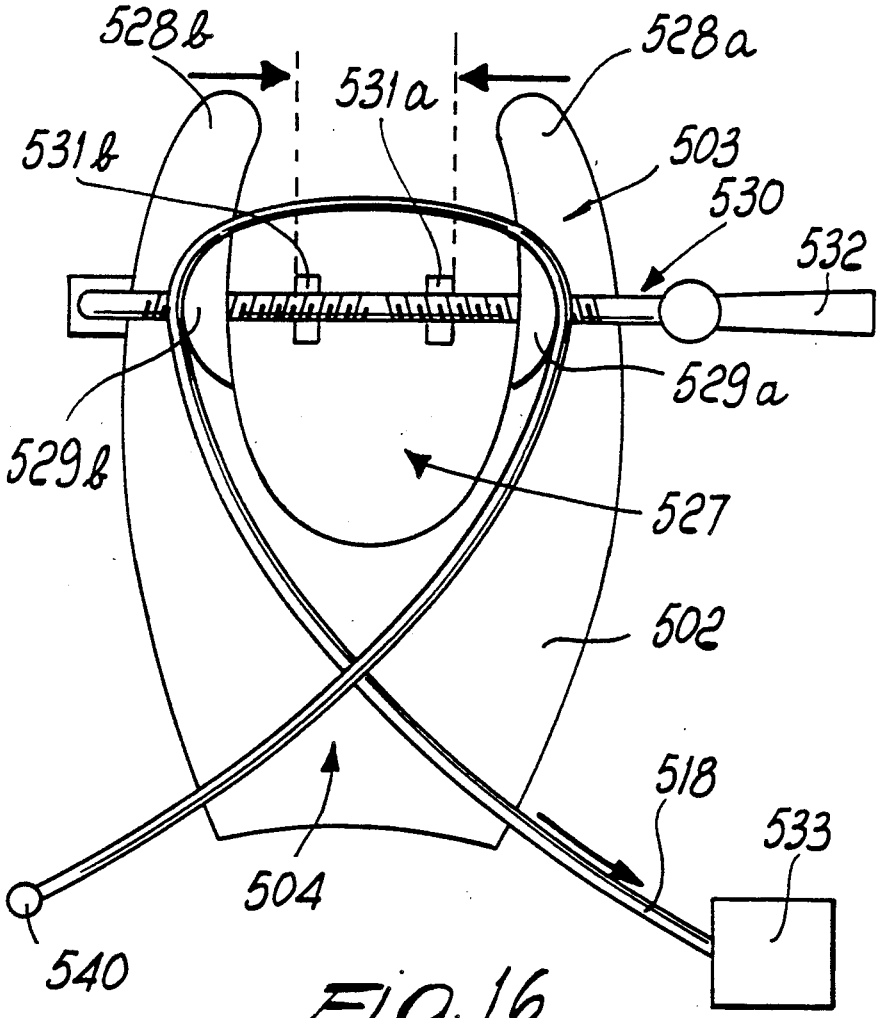
FIGS. 16 and 17 are views, respectively similar to FIGS. 14 and 13, of a sixth embodiment.
Figure 17:
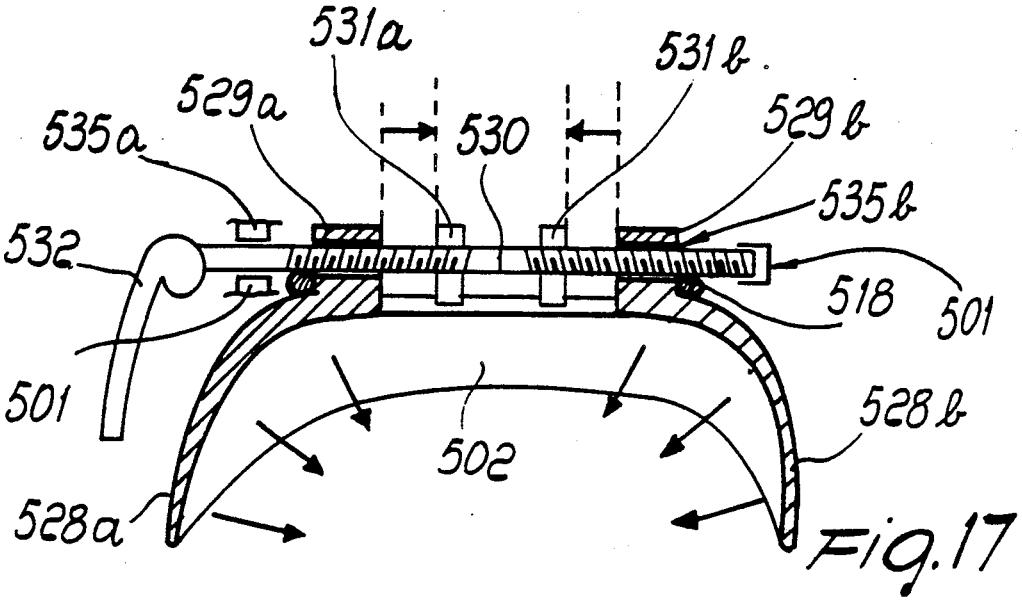

FIGS. 16 and 17 illustrate a sixth embodiment, wherein the presser 502 has a longitudinal notch 527 at the first metatarsal region 503 which again defines a pair of elastically deformable and mutually approachable flaps 528*a* and 528*b*.

A pair of shoulders 529*a* and 529*b* protrudes from said flaps at the first metatarsal region towards the overlying shell or quarter; said shoulders, at their sides looking away from the notch 527, have a curved, outwardly convex shape.

Furthermore, the shoulders define two aligned holes 535*a* and 535*b* accommodating a threaded stem 530 freely rotatable therein and having opposite threads engaging in complementarily threaded sleeves 531*a* and 531*b*, arranged at the longitudinal notch 527.

Said threaded stem 530 is rotatably associated with said shell or quarter 501 at one end and protrudes therefrom at the other end where the stem is associated with an actuating lever 532.

The second means can be activated from the outside of the boot by means of adapted tensioning elements 533 acting on one end of a cable 518 which embraces said shoulders 529*a* and 529*b* at their curved surface, then crosses at the second foot-instep region 504 and is subsequently secured, for example to the shell or quarter, at its other end 540.

When the cable is tensioned, the flaps 528*a*, 528*b* are moved mutually closer until they abut against the sleeves 531*a* and 531*b*, the position whereof has been preselected by means of the lever 532.

Said sleeves 531*a* and 531*b* naturally cannot rotate with respect to the stem 530 but can only move when said stem is rotated, e.g. by virtue of the engagement in a suitable slot in the inner side of the boot.

The materials and dimensions of the individual components which constitute the device may naturally be the most pertinent according to the specific requirements.

We claim:

1. In combination, a foot securing device for ski boots and a ski boot, said foot securing device comprising;

at least one presser arranged inside said ski boot, a metatarsal region defined on said presser, a foot instep region defined on said presser, a grip element connected to said presser and being accessible from outside of said ski boot, means for exerting pressure at said metatarsal region of said presser, first means for adjusting said pressure at said metatarsal region of said presser, at least one traction element spanning said presser at said foot instep region thereof, second means connected to said traction element and being actuatable from outside of said ski boot for tensioning said at least one traction element, wherein said first means are actuated by said grip element and intersect with said presser upon actuation of said second means, and, wherein said presser is longitudinally movably connected to said ski boot.

2. Combination according to claim 1, wherein said first means comprises a hollow bush and a pawl, said grip element being rotatable associated with said footwear, said bush being connected to said grip element for rotation therewith and having an internally threaded portion, said pawl having a complimentary threaded head, said internally threaded portion of said bush engaging with said complimentarily threaded head of said pawl, said complementary threaded head being axially slidable with respect to said bush and having an end, said end being arranged inside said ski boot facing said presser.

3. Combination according to claim 2, wherein said end of said pawl arranged inside said ski boot is rigidly coupled to a plate, said plate being vertically slidable with respect to said presser.

4. Combination according to claim 1, wherein said presser defines at least one bridge, said bridge protruding from said foot instep region of said presser, said traction element being slidably connected to said bridge whereby to guide said traction element.

5. Combination according to claim 2, wherein said end of said pawl arranged inside said ski boot is rigidly coupled to a plate, said plate being vertically movable with respect to said presser, wherein said presser has pivotally connected thereto at least one pair of connecting rods, each of said connecting rods having at least one end and at least one other end, and wherein said plate has a pair of lateral wings, said wings each being directed towards said ski boot, said one end of each of said connecting rods being articulated to one of said lateral wings, said other end of each of said connecting rods being pivotally connected to said plate.

6. Combination according to claim 2, wherein said end of said pawl arranged inside said ski boot is rigidly coupled to a plate, said plate being vertically slidable with respect to said presser, wherein said tension element comprises a U-shaped tension element, said U-shaped tension element defining tension element ends, and wherein said presser has pivotally connected thereto at least one pair of connecting rods, each of said connecting rods having at least one end and at least one other end, said plate having a pair of lateral wings, said wings each being directed towards said ski boot, said one end of each of said connecting rods being articulated to one of said lateral wings, said other end of each of said connecting rods being rotatably connected to one of said tension element ends.

7. In combination, a ski boot and a foot securing device, said ski boot having an inner surface, said foot securing device comprising;

adjustment means connected to said ski boot, a downwardly extending adjustment axis of rotation defined by said adjustment means, connection means movably connected to said adjustment means, said connection means being simultaneously movable downwardly and in a direction extending substantially orthogonal to said adjustment axis, at least one presser connected to said connection means, and being movable downwardly and longitudinally therewith inside said ski boot, said adjustment means including means for positioning said presser at a selected distance from said inner surface, at least one traction element engaging at least one portion of said presser, and tensioning means connected to said traction element for selective tensioning thereof, whereby to longitudinally and downwardly move said connection means and said presser with respect to said inner surface upon actuation of said tensioning means, while maintaining positioning of said presser imposed by said adjustment means upon releasing said tensioning means.

8. Combination according to claim 7, wherein said adjustment means comprises at least one adjustment knob rotatably associated with said ski boot, and wherein said means for positioning said presser comprise screw thread means interconnecting said adjustment knob and said connection means.

9. Combination according to claim 8, wherein said screw thread means comprise;

at least one internally hollow threaded bush rigidly connected to said adjustment knob, at least one threaded pawl, at least one screw thread formation defined by said pawl and threadedly engaging said internally hollow threaded bush, at least one end defined by said pawl and being connected to said connection means.

10. Combination according to claim 7, wherein said connection means comprise;

a plate connected to said adjustment means and being interposed between said presser and said inner surface of said shell, at least two connecting rods each having at least one connecting rod end and at least another connecting rod end, each said one connecting rod end being pivotally connected to said plate, each said other connecting rod end being pivotally connected to said presser.

11. Combination according to claim 10, further comprising;

at least two wings rigidly connected to said plate, each said one connecting rod end being pivotally connected to at least one of said wings, at least two raised portions rigidly connected to said presser, each said other connecting rod end being pivotally connected to at least one of said raised portions.

12. Combination according to claim 10 further comprising;

at least two wings rigidly connected to said plate, each said one connecting rod end being pivotally connected to at least one of said wings, and at least two raised portions rigidly connected to said presser, each said other connecting rod end being pivotally connected to at least one of said raised portions, wherein said wings protrude upwardly towards said inner surface of said shell, and wherein said raised portions protrude upwardly from said presser towards said inner surface of said shell.

13. Combination according to claim 10, further comprising;

at least two wings rigidly connected to said plate, each said one connecting rod end being pivotally connected to at least one of said wings, at least two raised portions rigidly connected to said presser, each said other connecting rod end being pivotally connected to at least one of said raised portions, wherein said presser defines a longitudinal middle axis, and wherein said raised portions are arranged equidistantly from said longitudinal middle axis.

14. In combination, a ski boot and a foot securing device, said ski boot having an inner surface, said foot securing device comprising;

at least one externally activatable adjustment member rotatably connected to said ski boot, adjustment means threadedly connected to said adjustment member and defining a downwardly extending adjustment axis, connection means simultaneously movable downwardly and substantially orthogonally with respect to said adjustment axis, at least one presser connected to said connection means and being movable therewith downwardly and longitudinally inside said ski boot, said adjustment means including means for positioning said presser at a selected distance from said inner surface, at least one traction element engaging at least one portion of said presser, and tensioning means connected to said traction element, for effecting tensioning thereof, whereby to longitudinally and downwardly move said connection means and said presser with respect to said inner surface upon actuation of said tensioning means, while maintaining positioning of said presser imposed by said adjustment means upon releasing said tensioning means.

15. Combination according to claim 14, wherein said adjustment means comprise screw thread means, said screw thread means comprising;

at least one internally hollow threaded bush rigidly connected to said adjustment member, at least one pawl, at least one screw thread formation defined by said pawl and threadedly engaging said internally hollow threaded bush, at least one end defined by said pawl and being connected to said connection means.

16. Combination according to claim 15, wherein said pawl is axially movable with respect to said bush, and wherein said connection means are longitudinally movable with respect to said bush and said pawl.

17. Combination according to claim 14, wherein said presser defines a first metatarsal region and a second foot instep region, said second foot instep region having rigidly connected thereto a plurality of bridges, said bridges slidably accommodating at least one traction element.

18. Combination according to claim 14, wherein said connection means comprise;

a plate connected to said adjustment means and being interposed between said presser and said inner surface of said shell, at least two connecting rods each having at least one connecting rod end and at least another connecting rod end, at least two wings rigidly connected to said plate, each said one connecting rod end being pivotally connected to at least one of said wings, at least two raised portions rigidly connected to said presser, each said other connecting rod end being pivotally connected to at least one of said raised portions.

* * * * *